US005381578A

United States Patent [19]

Armbruster

[11] Patent Number: 5,381,578

[45] Date of Patent: Jan. 17, 1995

[54] POLISHER WITH RECTANGULAR PAD AND HANDLE ASSEMBLY

[76] Inventor: Joseph M. Armbruster, 2700 NE. 47 St., Lighthouse Point, Fla. 33064

[21] Appl. No.: 987,699

[22] Filed: Dec. 9, 1992

[51] Int. Cl.[6] ..... A47L 11/284

[52] U.S. Cl. ..... 15/98; 15/50.2; 15/145; 15/176.1

[58] Field of Search ..... 15/22.1, 49.1, 50.2, 15/52.2, 98, 176.1, 145, 154, 250.19; 51/175, 177, 170 TL; 30/122, 500; 16/114 R

[56] References Cited

U.S. PATENT DOCUMENTS

| | | | |
|---|---|---|---|
| 1,661,510 | 3/1928 | Sproston | 15/98 |
| 2,268,015 | 12/1941 | Broberg | 15/49.1 |
| 2,417,620 | 3/1947 | Soderberg | 15/98 |
| 2,782,452 | 2/1957 | Kitto et al. | 15/385 |
| 3,362,037 | 1/1968 | Griffin | 15/145 |
| 3,445,877 | 5/1969 | Stout | 15/98 |
| 3,533,120 | 10/1970 | DeMercado | 51/175 |
| 3,688,139 | 8/1972 | Yaguchi | 310/50 |
| 4,202,068 | 5/1980 | Lester et al. | 15/28 |
| 4,266,315 | 5/1981 | Skahill | 15/250.19 |
| 4,724,567 | 2/1988 | Rones | 15/98 |
| 4,747,176 | 5/1988 | Parks | 15/98 |
| 4,907,313 | 3/1990 | Roeker et al. | 15/98 |
| 5,003,659 | 4/1991 | Paepke | 15/145 |
| 5,084,938 | 2/1992 | Knestele | 15/98 |

*Primary Examiner*—David A. Scherbel
*Assistant Examiner*—Reginald L. Alexander
*Attorney, Agent, or Firm*—Jacobson, Price, Holman & Stern

[57] ABSTRACT

A polisher or scrubber having a rectangular pad that is driven in a random orbital path for polishing or scrubbing floors or surfaces in which it is incorporated into two basic embodiments, one being a heavy duty embodiment provided with an elongated telescopic handle that is permanently attached to the housing or casing of the orbital polisher by an offset yoke arrangement in which the tubular handle receives a power cord for supplying alternating current to the electric motor in the casing of the polisher. The other embodiment is a smaller unit and is provided with a detachable handle connected with the casing by quick connect and disconnect structure and an offset yoke to enable the polisher to be used in hard to reach places and easily converted to a hand held and manipulated polisher by quickly and easily removing the elongated telescopic handle from the casing. In each embodiment, the casing is provided with stop members in the form of projecting areas formed or molded into the motor casing of the polisher with the pad including a generally rigid plate having depending small hooks bolted or formed on the lower surface thereof for detachable connection with interchangeable pads or polishing bonnets of rectangular configuration which may be provided with loop pile on the upper surface or the material of the pads may engage with the small hooks on the plate generally in the same manner as hook and loop pile fastener material available under the trademark "VELCRO".

15 Claims, 4 Drawing Sheets

FIG. 4
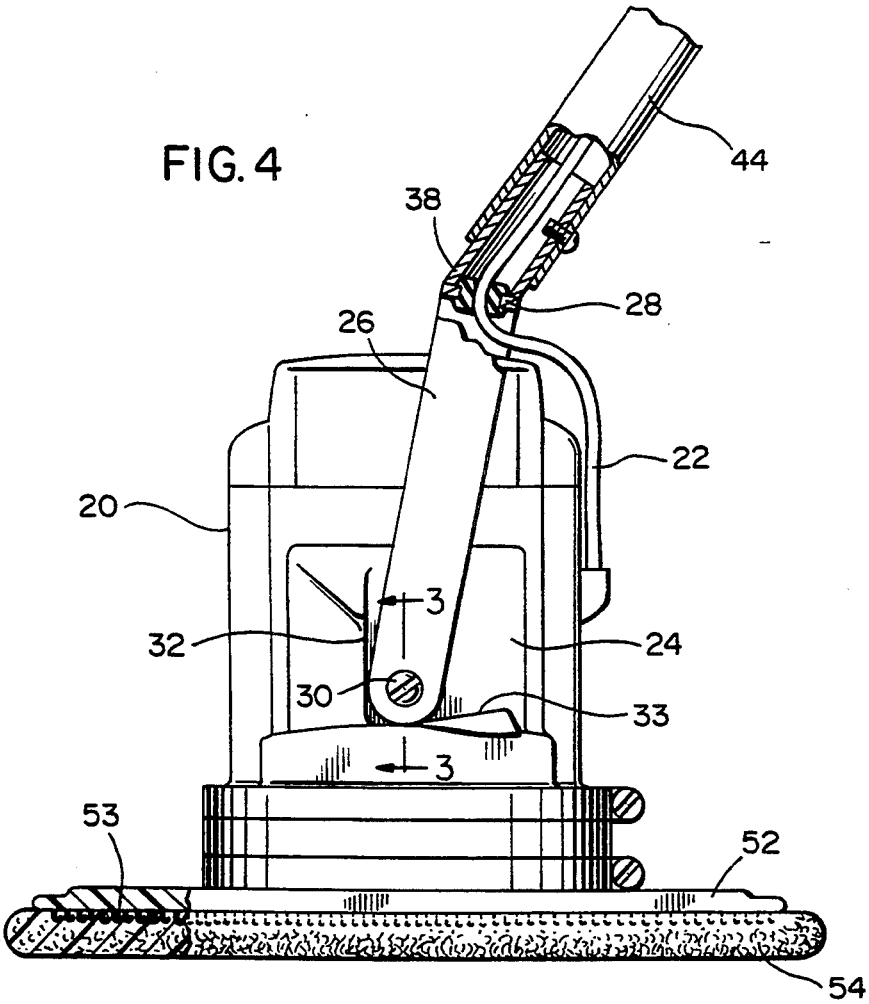
FIG. 5
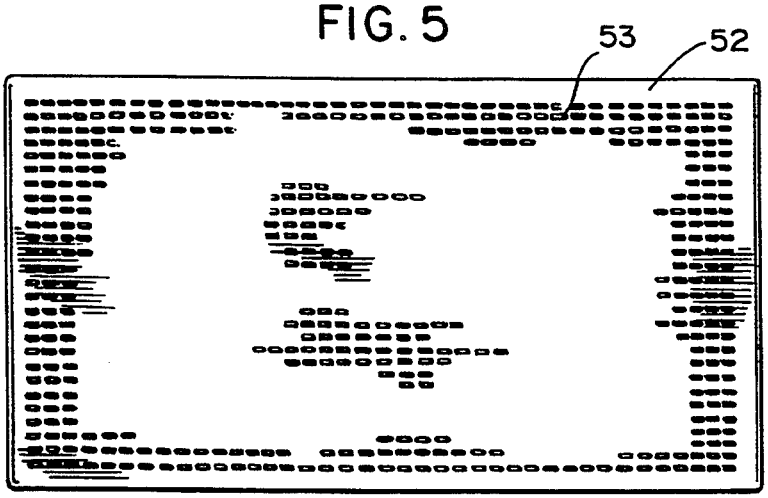
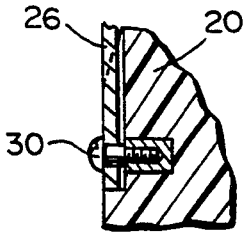
FIG. 6

POLISHER WITH RECTANGULAR PAD AND HANDLE ASSEMBLY

BACKGROUND OF THE INVENTION

FIELD OF THE INVENTION

The present invention generally relates to a polisher or scrubber having a rectangular pad that is driven in a random orbital path for polishing or scrubbing floors or other surfaces in which it is incorporated into two basic embodiments, one being a heavy duty embodiment provided with an elongated telescopic handle that is permanently attached to the housing or casing of the orbital polisher by an offset yoke arrangement in which the tubular handle receives a power cord for supplying alternating current to the electric motor in the casing of the polisher. The other embodiment is a smaller unit and is provided with a detachable handle connected with the casing by quick connect and disconnect structure and an offset yoke to enable the polisher to be used in hard to reach places and easily converted to a hand held and manipulated polisher by quickly and easily removing the elongated telescopic handle from the casing. An elongated power cord is connected with a receptacle on the handle with a built-in switch included in the power cord to enable an operator to clean or polish a large area with the receptacle enabling the shorter power cord from the hand-held polisher to be plugged in thereby providing control for the polisher from the built-in switch on the handle rather than from the switch on the housing of the polisher. In each embodiment, the casing is provided with stop members in the form of projecting areas formed or molded into the motor casing of the polisher with the pad including a generally rigid plate having depending small hooks molded or formed on the lower surface thereof for detachable connection with interchangeable pads or polishing bonnets of rectangular configuration which may be provided with loop pile on the upper surface or the material of the pads may engage with the small hooks on the plate generally in the same manner as hook and loop pile fastener material available under the trademark "VELCRO".

DESCRIPTION OF THE PRIOR ART

Portable power tools including those having rotational, reciprocating and orbital outputs are generally well known with such devices usually including a casing or housing provided with an electric motor supplied electrical energy by a power cord having a male plug on one end thereof for connection with a conventional outlet. Such devices also usually include a handle on the casing which is usually formed integral therewith together with a switch for controlling operation of the device. The output from the electric motor is provided with a detachable pad assembly to enable various operations to be performed and to enable replacement of operating pads or other work engaging surfaces.

However, a random orbit output tool is not available which includes an elongated handle structure connected to the casing by an offset yoke to facilitate use of the random orbit polisher with rectangular pads on floor surfaces or hard to reach surfaces in which the offset handle provides effective control of the polisher as compared to a handle that is straight throughout its length with one end connected to the housing of a power head of the electrically powered tool. In addition, the commercially available devices do not include an elongated handle that is permanently attached to a heavy duty random orbit polisher by an offset yoke with the handle being telescopic and tubular for receiving a power cord and providing with a control switch in the handle to control operation of the polisher. Further, a convertible orbit polisher is not known which is provided with an elongated handle connected to a smaller power head housing by an offset yoke with the yoke being attached and detached from the casing by quick connect spring pins or equivalent quick and easy pivotal connecting means with a switch assembly being provided on the handle associated with a power cord that is oriented externally of the handle with the smaller unit including a switch in the casing to enable the handle to be disconnected from the handle and the orbit polisher then used as a hand held polisher. Additionally, the available devices do not include the rectangular polishing pad and plate which greatly facilitates polishing corner areas of a floor or the like and other similar surface areas with the pads being easily attached to and removed from a supporting plate by the use of a fastener arrangement such as "VELCRO" that is incorporated directly into the generally rigid rectangular plate and corresponding shaped pads.

SUMMARY OF THE INVENTION

An object of the present invention is to provide a random orbit polisher having a rectangular pad assembly incorporated in one embodiment in which an elongated handle is permanently attached to a casing by an offset yoke and in another embodiment which includes an elongated handle assembly detachably connected to a casing or housing by an offset yoke and quick connect structures which enable the polisher to be converted from one having an elongated handle to one being hand held and controlled.

Another object of the invention is to provide a polisher in which the elongated handle and offset yoke are pivotally connected to a housing provided with stops to limit the pivotal movement between the housing and yoke in one direction with the handle being telescopic and receiving a power card interiorly thereof with a control switch being provided in the power cord adjacent the end of the handle remote from the yoke.

A further object of the invention is to provide a polisher in which the offset yoke includes spring biased pins mounted on the ends of the legs of the yoke for reception in socket holes formed in the housing of the polisher to enable easy assembly and disassembly of the handle with respect to the housing with the power cord being disposed externally of the handle and connected with a switchbox and plug assembly by which the polisher having the switch on the housing can also be controlled from the handle remote from the polisher with the housing of the polisher also including an integral handle formed in the housing to enable the polisher to be hand held and manipulated when the handle is removed.

A still further object of the invention is to provide a polisher in accordance with the preceding object in which the handle is provided with an elongated power cord, on the order of 20 ft., to enable large areas to be polished with a switch and receptacle associated with the power cord to enable the relatively short power cord on the hand-held polisher to be connected to the elongated cord by plugging into the receptacle.

Still another object of the invention is to provide a polisher in accordance with the preceding objects in which the polishing pad and supporting plate are rectangular and provided with a hook and loop pile fastener to enable interchange of polishing pads with the rectangular configuration facilitating polishing work surfaces in corners and adjacent to vertical walls and the like such as floor surfaces in the corner of a room and adjacent vertical wall surfaces.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a detailed view of the power head including the housing and the structure of the rectangular pad and plate.

FIG. 5 is a bottom view of the plate.

FIG. 6 is a sectional view taken along section line 6—6 on FIG. 4 showing the pivotal connection of the yoke.

DETAILED DESCRIPTION OF THE PREFERRED EMBODIMENTS

Figure 1:
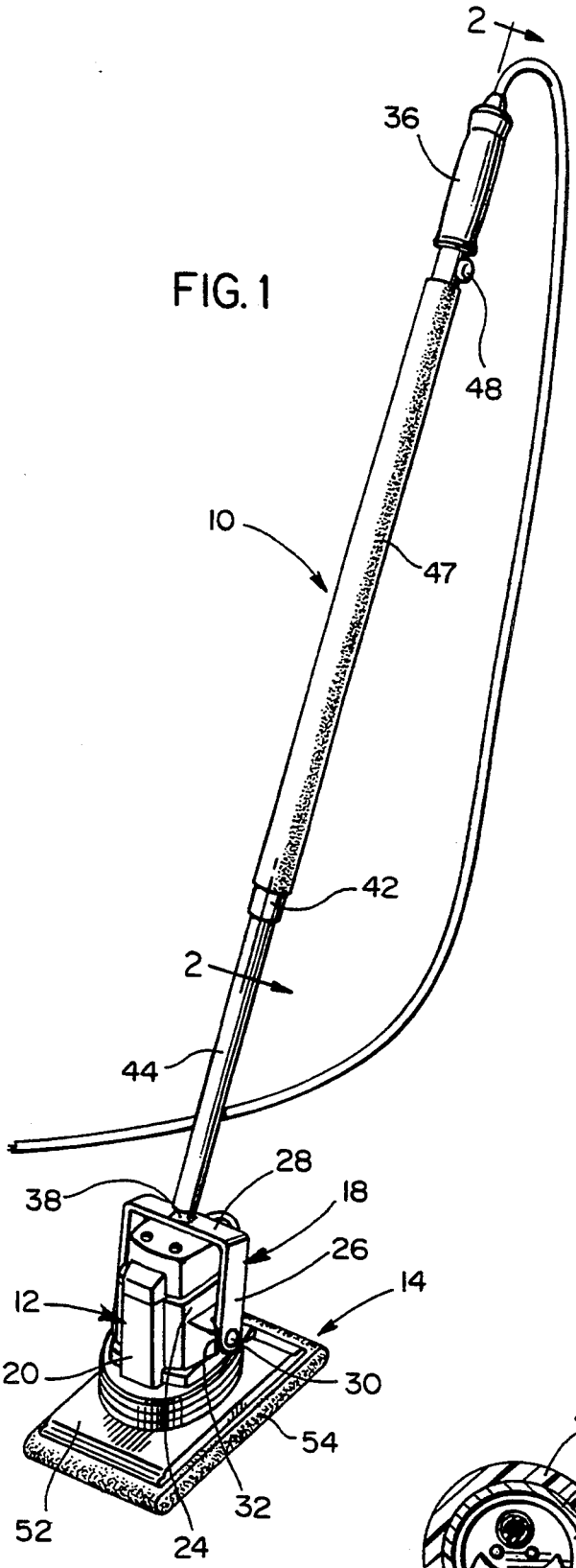
FIG. 1 is a perspective view of a heavy duty embodiment of the polisher illustrating the association of the permanently attached handle and offset yoke to the housing or casing of the polisher.
Figure 2:
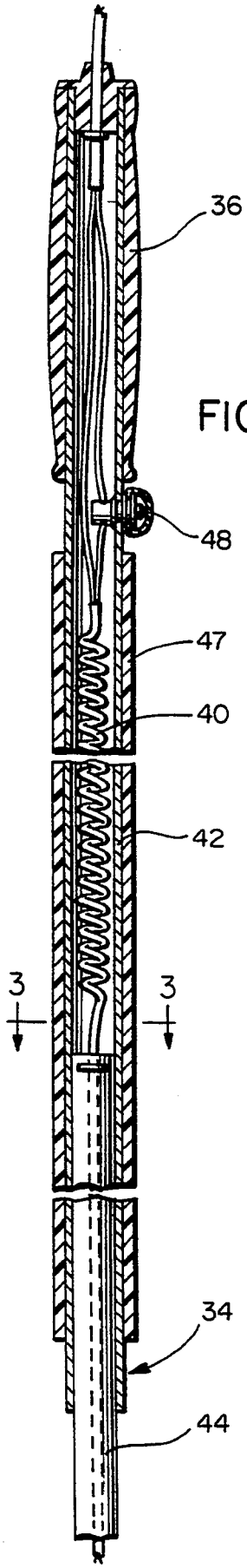
FIG. 2 is a longitudinal sectional view of the three section telescopic handle illustrating the association of the components of the handle with the power cord and switch.
Figure 3:
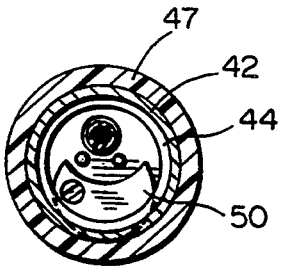
FIG. 3 is a transverse sectional view taken along section line 3—3 on FIG. 2 showing the handle lock structure.

Referring now specifically to FIGS. 1–6 of the drawings, the heavy duty form of the polisher of the present invention is generally designated by reference numeral 10 and includes a power head generally designated by reference numeral 12, a polishing unit generally designated by reference numeral 14 driven from the power head 12, a handle assembly generally designated by reference numeral 16 that is connected to the power head by an offset yoke generally designated by reference numeral 18.

The power head 12 includes a housing or casing 20 for an electric motor (not shown) having a power cord 22 extending therefrom. The casing 20 may be of any suitable configuration but generally of cylindrical configuration provided with substantially flat side surfaces 24 to which the yoke 18 is pivotally attached.

The yoke 18 includes a pair of arms or legs 26 interconnected by a web or bight portion 28 to provide a rigid, generally U-shaped structure with the free ends of the arms or legs 26 being pivotally connected to the housing 20 by pivot pins or bolts 30 to pivotally secure the yoke substantially permanently to the housing 20 while permitting pivotal movement of the yoke about a transverse axis defined by the pins or bolts 30. The housing 20 includes spaced outwardly extending projections 32 and 33 on each flat side wall area 24 which forms an abutments or stops for the yoke 18 when the edges of the arms or legs 26 come into contact with the projections 32 or 33. The projections 32 and 33 are formed integrally with the housing such as when the housing is molded.

The handle assemble 16 includes a sectional telescopic tubular member 34 having a hand grip 36 on the outer end thereof and an offset 38 at an inner end thereof which is connected rigidly with the yoke whereby the handle and yoke are offset in relation to the pivot axis defined by the pivot pins or bolts 30. The power cord 22 extends through the tubular handle member 34 and includes a spiral portion 40 which enables the tubular member 34 to be adjusted longitudinally. The tubular member 34 includes a plurality of sections 42 and 44 which telescope in relation to each other to enable the tubular handle 34 to be adjusted in length with the spiral portion of the power cord enabling extension and retraction of the tubular member 34. A resilient sleeve 47 is formed or mounted on the tubular member 42 to facilitate handling. A switch 48 is mounted in the tubular member adjacent the hand grip 36 with the switch being incorporated into the power cord 22 which then extends out from the end of the hand grip 36 with a suitable strain relief device securing the power cord to the tubular member 42. The free end of the power cord is provided with the usual male plug for insertion into a wall socket or the like to supply AC electrical energy to the polisher. A suitable cam type lock 50 or other telescopic tubular lock may be used to adjustable secure the telescopic sections of the tubular member in adjusted position with one type of cam lock adequate for these purposes being disclosed in my copending application Ser. No. 07/804,581 filed Dec. 10, 1991 for DC powered scrubber.

The pad assembly 14 includes a plate 52 of rectangular configuration and substantially rigid construction which may be constructed of plastic material with a plurality of small hooks 53 formed on the lower surface thereof. The plate is secured to an output of the power head by a detachable connection through a reduction gear and clutch arrangement such as is shown in the aforementioned copending application. The detachable connection enables the pad assembly 14 to be easily removed and replaced when desired. The pad assembly 14 also includes a pad 54 of flexible material which may be in the form of a foam plastic pad, lambs wool pad or other similar pads used for polishing and cleaning. The upper surface of the pad 54 may be provided with a plurality of loops to coact with and be attached to the hooks on the plate 52. The material of the pad itself may suffice to form loops to engage detachable with the hooks to enable replacement of the pad 54 in relation to the plate 52 when desired or necessary depending upon the nature of the work to be performed.

FIGS. 7–11 disclose a convertible embodiment of the polisher which is substantially smaller and weighs substantially less than the heavy duty polisher illustrated in FIGS. 1–6. This embodiment of the polisher is generally designated by reference numeral 60 and includes a power head 62, a pad assembly 64, a handle assembly 66 and a yoke assembly 68 which are structured and function in a similar manner to the heavy duty embodiment of the invention 10. In this construction, the power head 62 includes a housing or casing 70 having oppositely disposed sockets or apertures 72 therein for releasably receiving the inner ends of pins 74 which are movably mounted on the offset yoke 68, provided with a finger ring 76 on the outer end thereof and a spring 78 which biases the pins 74 inwardly into the socket 72. Thus, the handle assembly 66 can be attached to or removed from the power head 62 by utilizing the spring pins 74 which also define a pivot axis for the yoke 68 and handle 66. This structure enables the polisher power head 62 and the pad assembly 64 to be hand held and manipulated by the use of a built in handle 80 forming a part of the housing 70 which may be in the form of a shaped area or the type of handle that is integral with or molded with the housing 70 thus enabling the polisher to be converted from a hand held and manipulated polisher to a polisher with a pivotal offset handle assembly 66 by the use of spring bias pins 74. Otherwise, the structure of the power head and pad assembly are the same as in FIGS. 1–6 and includes projecting stops for the yoke 68 to limit pivotal movement of the handle assembly in both directions.

In this form of the invention, the power cord 82 which extends from the power head 62 extends along the exterior of the telescopic tubular member 84 which forms the handle assembly 66 to a receptacle on switchbox 85 adjacent the hand grip 86 on the tubular member 84 with the switchbox 85 including a switch 88 and an extension power cord 90 connected therewith thereby enabling control of the polisher unit 60 from the end of the handle assembly 66 remote from the power head 62 rather than from switch 92 on housing 70. When the handle assembly 66 is removed, the power cord 82 is unplugged from the receptacle on the switchbox 85 and plugged into a wall socket or the like to enable the use of switch 92 on the power head 62 to be used to control the polisher when it is being hand held and manipulated.

Figure 7:
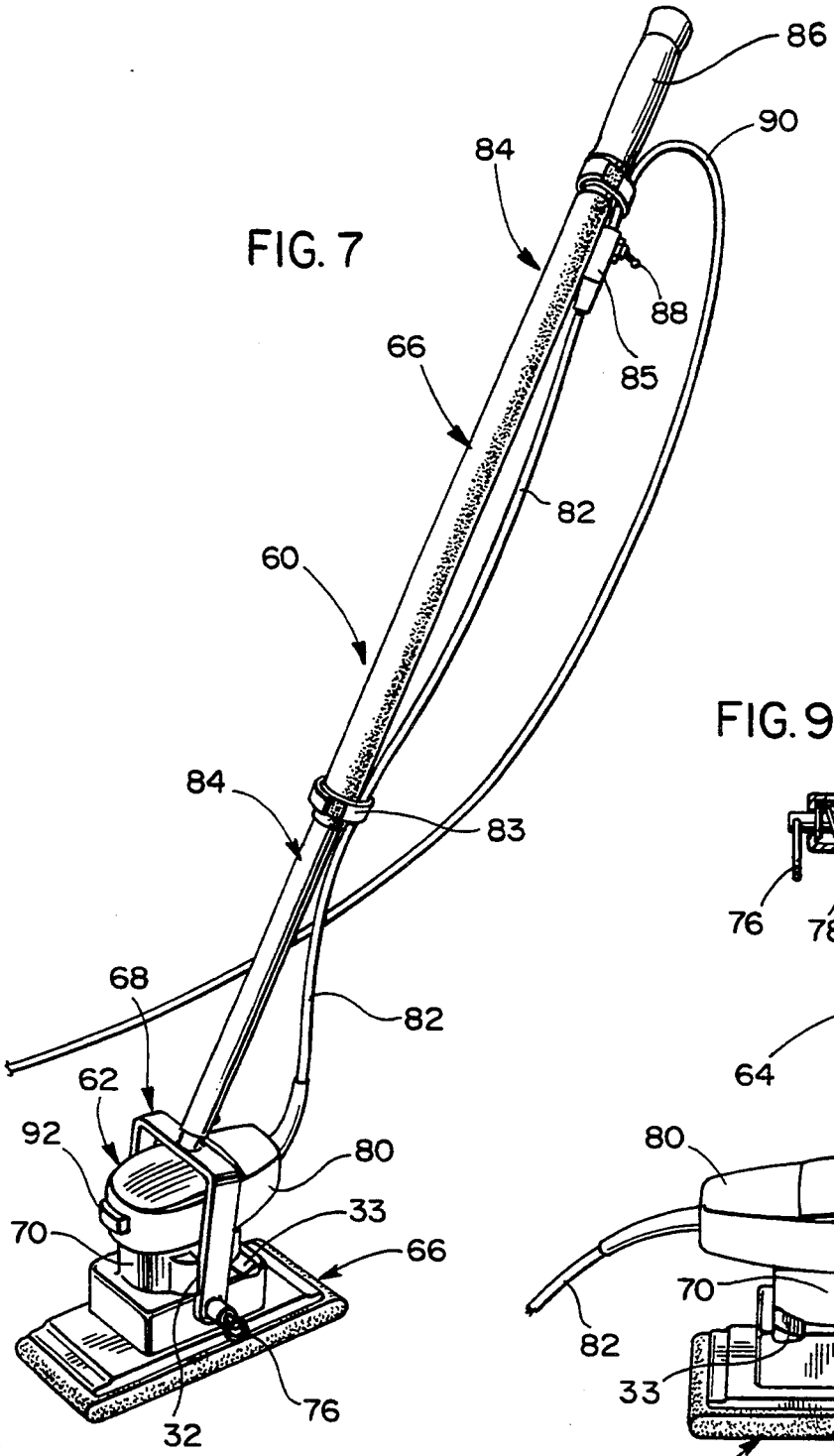
FIG. 7 is a perspective view of the embodiment of the polisher in which the handle and offset yoke are detachable by the use of spring pins.
Figure 8:
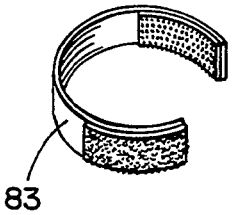
FIG. 8 is a perspective view of the power cord strap.
Figure 9:
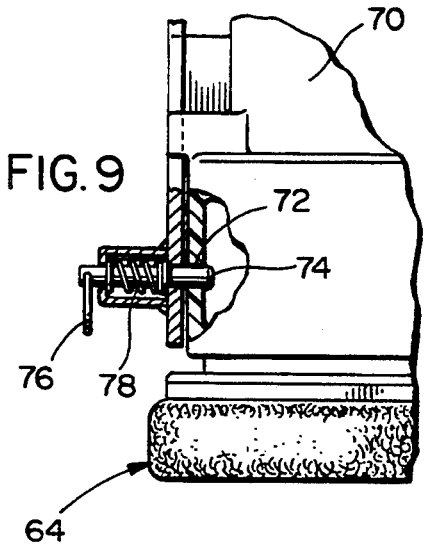
FIG. 9 is a detailed view illustrating the specific construction of the yoke and spring biased connecting pins.
Figure 10:
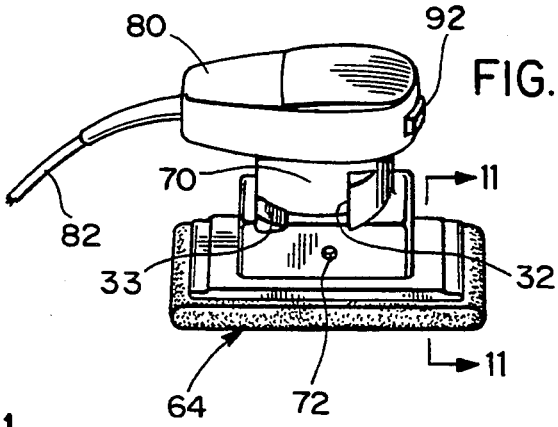
FIG. 10 is a perspective view of the hand held embodiment of the invention.
Figure 11:
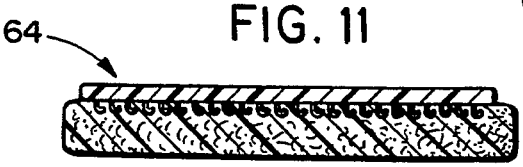
FIG. 11 is a sectional view taken along section line 11—11 on FIG. 10 showing the plate and pad structure.
Figure 12:
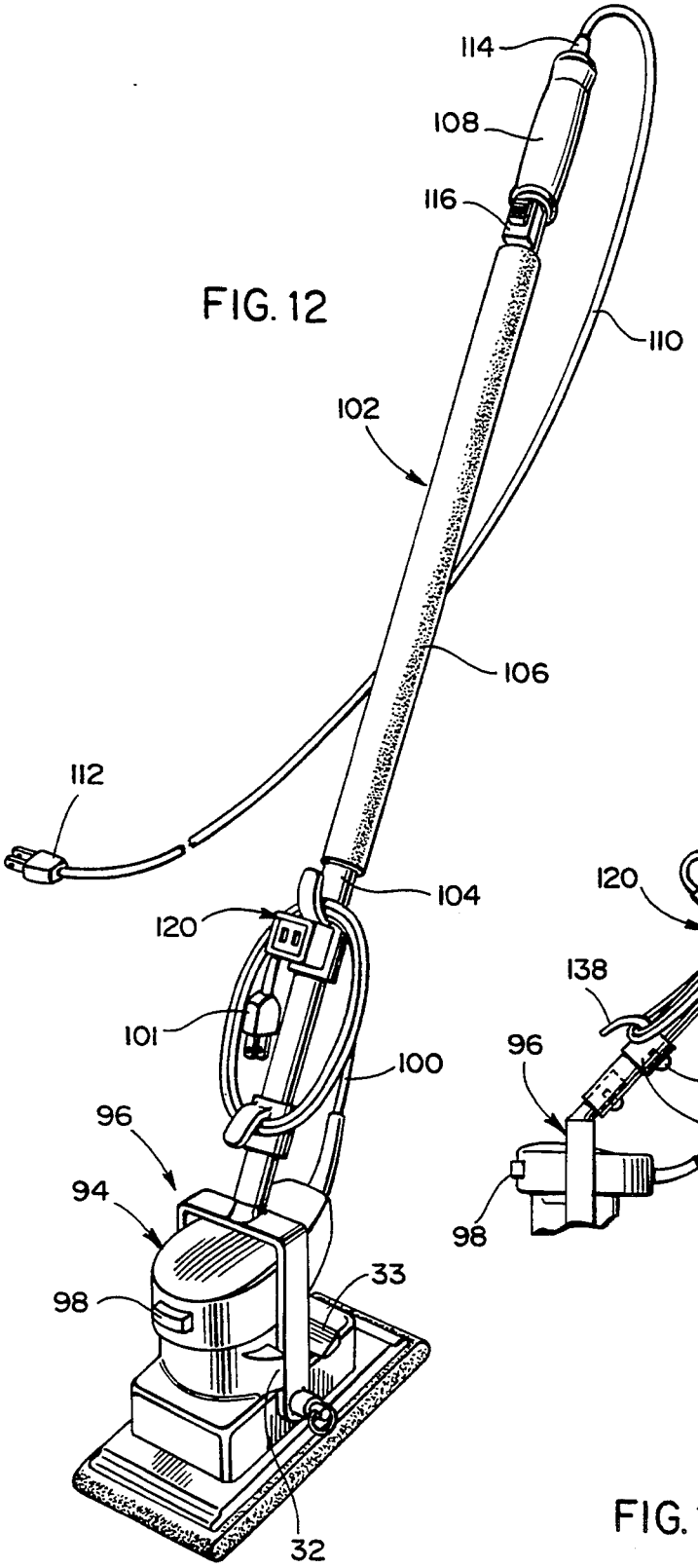
FIG. 12 is a perspective view of the polisher illustrating another embodiment of the power cord assembly.
Figure 13:
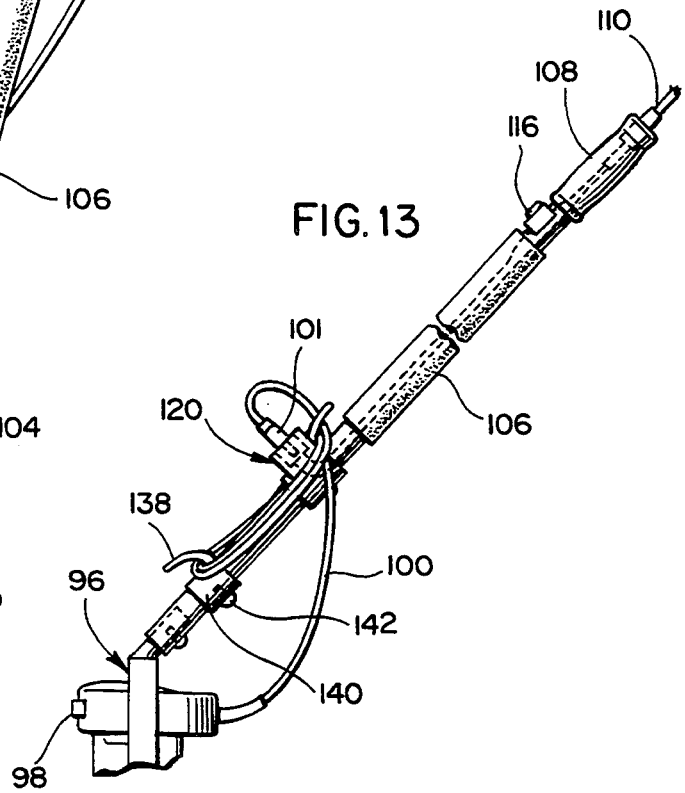
FIG. 13 is a fragmental side elevational view illustrating the power cord assembly in use.
Figure 14:
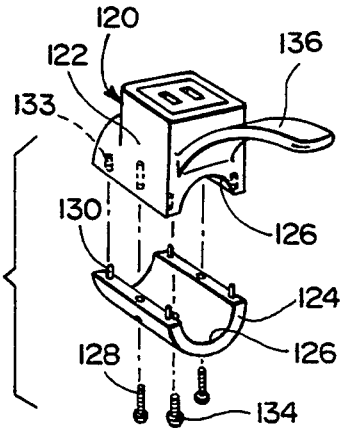
FIG. 14 is an exploded group perspective view of the receptacle and mounting structure for the receptacle.

The embodiment of the polisher illustrated in FIGS. 12–14 is similar to the other embodiments with the hand held polisher generally designated by reference numeral 94 being the same as the polisher 62 in FIG. 7 with the yoke 96 attached in the same manner, provided with the same stops, pad and a manually operated switch 98 similar to the switch 92 in FIG. 7. The hand held polisher 94 is provided with a relatively short, approximately 6 ft., power cord 100 connected thereto which is provided with a male plug 102 at the free end thereof. The housing, switch and cord 100 represent conventional hand held polishers with the novel pad of this invention and the novel handle structure of this invention attached thereto. The yoke and handle structure, generally designated by reference numeral 102 is substantially the same as that in FIG. 7 and includes a tubular member 104 with a resilient sleeve 106 thereon and a hand grip 108 at the upper end thereof. An elongated power cord 110 having a male plug 112 on one end thereof is connected with the handle 102 and extends into the interior of the end of the handle through a strain relief device 114. A built in push on, push off switch 116 is mounted inwardly of the hand grip 108 and is incorporated into the power cord 110. The power cord 110, on the order of 20 ft. in length, extends inwardly through the handle 14 and extends out through a hole in the tubular member 104 for electrical connection with a female receptacle or socket 120 which includes an upper body member 122 and a lower body member 124 which is of semicylindrical construction with both of the body members including a semicylindrical interior surface 126 for clampingly engaging the tubular member 104 by the use of screws 128 which extend up through the edge portions of the body 124 into screw threaded recesses in the body 122. A pair of dowels 130 is provided on each edge of the body 124 for telescopic reception in correspondingly spaced sockets 132 in the body member 122 thereby securely clamping the body members 124 and 122 in accurate alignment with each other and secured to the tubular member 104. A centrally disposed rivet 134 or the similar fastener may be utilized to anchor member 124 and receptacle 120 to the tubular member 104 in stationary position thereon. The body member 122 includes an outwardly and upwardly extending curved retainer 136 which projects a short distance toward the hand grip 108. The tubular member 104 is provided with a second cord retainer 138 which extends upwardly in a curved manner toward the yoke 96 of the handle assembly thus enabling the excess power cord 100 to be wrapped thereon. The retainer 138 includes a cylindrical body member 140 anchored in place by a rivet 142 or other fastener device which enables the body member 140 to be positioned on the tubular member 104 before the tubular member 104 is anchored to the yoke 96. This structure enables the handle 102 which has a long cord associated therewith to be used thereby allowing an operator to clean or polish a large floor area without the necessity of using an extension cord. As illustrated in FIGS. 12 and 13, the approximately 6 ft. long line cord 100 from the hand held polisher 94 wraps around the two retainers 136 and 138 and plugs into the receptacle 120 which faces upwardly and is integral with the cord retainer 136. FIG. 12 illustrates the plug 101 on the cord 100 removed from the receptacle 120 while FIG. 13 illustrates the plug 101 plugged into the receptacle. FIG. 14 illustrates the details of the receptacle 120 with the two halves or body members 122 and 124 being aligned by the dowels 130 and secured in place by the screws 128 and the single rivet 134. The front retainer body member 140 is a molded component and is assembled by sliding it over the tubular member 104 before the yoke is inserted into member 104 with the body member 140 being secured in place by the rivet 142. The approximately 20 ft. line cord 110 exits from the fixed length aluminum tube handle member 104 which is approximately 52 inches long and the line cord 110 is wired into the push on/push off switch 116 and then attached to the receptacle which can be molded into the line cord retainer or it can be a flat, barbed spring loaded type receptacle that is pushed in from the top. With this construction of the handle and the switch 116 located in front of the hand grip 108, the operator can turn the polisher on and off without bending over to actuate the switch 98 built into the polisher. To operate, the built in polisher switch 98 is turned on and left on after the handle has been installed and subsequent on/-off control is then transferred to the built in push on/-push off switch 116 in the handle 102.

The polishers disclosed with a rectangular pad and the alternative handle assemblies facilitate the use of the polisher for floor surfaces or other similar surfaces especially where corner areas or areas adjacent to vertical wall surfaces or other vertical obstructions are to be cleaned or polished. The flexible soft pad may be interchanged or replaced when necessary by use of the "VELCRO" fastener arrangements or the entire pad assembly may be easily removed and replaced by the connection between the output of the power head and the pad plate. The offset handle enables manipulation of the polisher in a manner to enable accurate control and movement of the polisher on horizontal surfaces or inclined surfaces.

The foregoing is considered as illustrative only of the principles of the invention. Further, since numerous modifications and changes will readily occur to those skilled in the art, it is not desired to limit the invention to the exact constructions and operation shown and described, and, accordingly, all suitable modifications and equivalents may be resorted to, falling within the scope of the invention.

What is claimed as new is:

1. A polisher comprising a power head having an output, a pad assembly connected to said power head output for movement in a single plane, said pad assembly including a plate having straight, opposed, generally parallel, peripheral edge portions, and a pad mounted on said plate with the pad having peripheral edge portions generally aligned with the peripheral edge portions of said plate, means detachably connecting the pad to said plate, and handle means operatively associated with the power head to enable manipulation of the power head and pad assembly when the pad assembly is in contact with a worksurface, said power head including a power cord for supplying electrical energy to the power head, said handle means including an elongated member having hand grip means adjacent one end thereof and an offset U-shaped yoke at the other end, means pivotally connecting the yoke to said power head, said means connecting the yoke to the power head including retractable pivot pin means mounted on said yoke, said powerhead including a housing having opposed, aligned sockets therein for receiving said pivot pin means, said pivot pin means including a pair of aligned and opposed spring biased pins mounted on said yoke with the pins being biased into the sockets, and means on each of the pins forming a handle to enable the pins to be retracted for removal from the sockets thereby enabling the handle means including the hand grip means and yoke to be separated from the power head housing.

2. The polisher as defined in claim 1 wherein said power head housing includes stop means thereon to limit pivotal movement of the yoke to a predetermined angular relation between the yoke and power head housing.

3. The polisher as defined in claim 1 wherein said means connecting the pad to the plate including hook and loop pile fastener assemblies.

4. The polisher as defined in claim 1 wherein said plate includes a bottom surface of generally planar construction having a plurality of depending hooks formed unitarily with the plate, said pad including loop means thereon for detachable engagement with the hooks.

5. The polisher as defined in claim 1 wherein said hand grip means includes a hand grip mounted on said elongated member, said power cord being disposed longitudinally along said member, said elongated member including switch means mounted thereon adjacent the hand grip and associated with the power cord for selectively supplying electrical energy to the power head.

6. The polisher as defined in claim 1 wherein said power cord is disposed longitudinally along said elongated member, said hand grip means including a hand grip at the end of said elongated member remote from the power head, switchbox means mounted on said elongated member adjacent the hand grip for connection of the power cord thereto and an extension power cord connected to the switchbox for connection with a source of electrical energy thus enabling separation of the power cord from the elongated member when the handle means is detached from the power head thereby enabling the power cord to be connected to a source of electrical energy.

7. In combination, a portable powered unit having a housing, electric power cord means connected with the housing for supplying electrical energy and a manual switch on the housing for controlling operations of the powered unit with the housing being configured to enable hand held operation of the unit, a handle including an elongated member having a U-shaped yoke at one end and a hand grip at the other, means pivotally and detachably connecting the yoke to the housing of the powered unit to enable the powered unit to be manipulated by use of said handle, an elongated power cord connected to the handle and including a switch adjacent the hand grip on the handle, and a female receptacle mounted on the handle and electrically connected in the elongated power cord for receiving a male plug on the electric cord means connected to the housing of the unit thereby enabling operation of the unit by operating the switch adjacent the hand grip when the switch on the housing of the portable powered unit is in the on position thereby enabling control of the unit from the end of the handle having the hand grip thereon.

8. The combination as defined in claim 7 wherein said handle includes a cord retainer assembly mounted thereon adjacent the yoke on which the cord means is wound with the male plug thereon plugged into the female receptacle, said female receptacle being incorporated into said cord retainer assembly thereby enabling an operator to move the portable power unit over large areas without utilizing a separate extension cord and enabling the portable powered unit to be used with or without the handle connected thereto.

9. The combination as defined in claim 7 wherein said switch adjacent the hand grip is incorporated into a switchbox adjacent the hand grip, said switchbox including a female receptacle incorporated therein, the power cord means connected to the housing of the portable powered unit having a male plug thereon for reception in the receptacle on the switchbox to enable control of the portable powered unit from the switchbox when the switch on the housing of the portable powered unit is in on position.

10. The combination as defined in claim 7 wherein said portable power unit is in the form of a polisher having a rectangular pad movable in a planar path to enable the pad to engage and polish or clean generally flat surfaces, corner areas and the like.

11. The combination as defined in claim 10 wherein said pad includes a backing plate having a plurality of hook like projections on a bottom surface thereof and a polishing pad of fabric like material being engaged by and supported by said hook like projections to enable anchoring the pad in place on the backing plate and enabling removal and replacement of the pad.

12. The combination as defined in claim 7 wherein said elongated member is tubular, said elongated power cord being positioned interiorly of said tubular member, said hand grip being tubular and receiving said elongated power cord, said elongated power cord extending outwardly through said tubular member adjacent said yoke and being connected to said female receptacle.

13. A polisher comprising a power head having an output, a pad assembly connected to said power output for movement in a single plane, said pad assembly including a plate and a pad, means removably mounting the pad on the plate, an elongated handle having hand grip means at one end and an offset yoke at the other end, means pivotally connecting said yoke to said power head, a power cord electrically connected with said power head and extending longitudinally along said elongated handle, switch means on said handle remote from the yoke and electrically associated with the power cord for selectively supplying electrical energy to the power head, said power head including a housing, said yoke including laterally spaced legs straddling said housing, said means pivotally connecting the yoke to the housing including pivot pins extending laterally of the ends of the legs of the yoke remote from the elongated handle with the pivot pins being connected to opposite surfaces of said housing, said housing including a pair of laterally extending projections oriented in angular spaced relation about a pivot axis formed by the pivot pins and oriented in the path of movement of a leg of said yoke to form stop abutments to limit the relative pivotal movement between the yoke and power head to enable the power head and pad assembly to be oriented with the pad assembly engaging a generally horizontal surface or a generally vertical surface and preventing free pivotal movement of the yoke in relation to the housing beyond the projections.

14. The polisher as defined in claim 13 wherein said pivot pins are spring biased inwardly and removably received in sockets in opposed surfaces of the housing to facilitate quick separation and attachment of the handle in relation to the housing.

15. The polisher as defined in claim 13 wherein said projections are provided on opposite surfaces of said housing and include substantially planar surfaces angulated more than 45° in relation to each other and less than 90° in relation to each other to limit the pivotal movement between the handle and power head.

* * * * *